US006828890B2

(12) United States Patent
Cope et al.

(10) Patent No.: US 6,828,890 B2
(45) Date of Patent: Dec. 7, 2004

(54) HIGH INTENSITY RADIAL FIELD MAGNETIC ARRAY AND ACTUATOR

(75) Inventors: David B. Cope, Medfield, MA (US); Andrew M. Wright, Somerville, MA (US)

(73) Assignee: Engineering Matters, Inc., Newton, MA (US)

( * ) Notice: Subject to any disclaimer, the term of this patent is extended or adjusted under 35 U.S.C. 154(b) by 37 days.

(21) Appl. No.: 10/255,984

(22) Filed: Sep. 26, 2002

(65) Prior Publication Data

US 2003/0127317 A1 Jul. 10, 2003

Related U.S. Application Data

(60) Provisional application No. 60/325,123, filed on Sep. 26, 2001.

(51) Int. Cl.[7] ..... H01F 7/00

(52) U.S. Cl. ..... 335/296; 335/222; 335/229; 335/299; 335/306

(58) Field of Search ..... 335/222, 229, 335/234, 296–306; 310/90.5

(56) References Cited

U.S. PATENT DOCUMENTS

| | | | | |
|---|---|---|---|---|
| 5,097,161 A | | 3/1992 | Nashiki et al. | 310/12 |
| 5,847,480 A | * | 12/1998 | Post | 310/90.5 |
| 6,259,174 B1 | | 7/2001 | Ono | 310/13 |
| 6,304,320 B1 | | 10/2001 | Tanaka et al. | 355/73 |
| 6,316,849 B1 | | 11/2001 | Konkola et al. | 310/12 |
| 6,355,994 B1 | | 3/2002 | Andeen et al. | 310/15 |
| 6,408,045 B1 | | 6/2002 | Matsui et al. | 378/34 |
| 6,512,571 B2 | | 1/2003 | Hara | 355/53 |
| 6,590,355 B1 | | 7/2003 | Kikuchi et al. | 318/135 |
| 2001/0017490 A1 | | 8/2001 | Suzuki et al. | 310/12 |
| 2002/0190582 A1 | | 12/2002 | Denne | 310/14 |
| 2003/0030779 A1 | | 2/2003 | Hara | 355/53 |
| 2003/0052548 A1 | | 3/2003 | Hol et al. | 310/12 |

OTHER PUBLICATIONS

Image from PPT presentation, Corcoran Engineering, Apr. 2001, re: (Linear) Halbach Array Magnet Configuration.

* cited by examiner

*Primary Examiner*—Ramon M. Barrera
(74) *Attorney, Agent, or Firm*—Hayes Soloway P.C.

(57) ABSTRACT

A miniature actuator, e.g., for use in a Micro Air Vehicle, comprises at least one nested array of magnets, with an outer annular magnet with a magnetization pointing in an axial direction, a middle annular magnet with a radial magnetization, and an inner cylindrical magnet with a magnetization directed anti-parallel to the magnetization of the outer annular magnet. In one embodiment, a permanent magnet actuator comprises such an array, and a conductive coil having a current distributed over the volume of the conductive coil, wherein the magnetic field of the array is perpendicular to the current located in the coil. The coil may be located above or below the first magnetic array. In another embodiment, a conductive coil is disposed between two magnetic arrays. The coil may have a winding that is pancake-shaped, solenoidal, or toroidal and may comprise more than one winding. The magnetic arrays may be canted to permit the toroidal winding to expand, affording control over the spread of the magnetic field in the gap.

84 Claims, 16 Drawing Sheets

HIGH INTENSITY RADIAL FIELD MAGNETIC ARRAY AND ACTUATOR

CROSS REFERENCE TO RELATED APPLICATION

This Application claims priority from U.S. Provisional Application Ser. No. 60/325,123, filed Sep. 26, 2001.

FIELD OF THE INVENTION

The present invention relates to the field of actuators, and in particular, direct drive actuators employing a radial magnetic field acting on a conducting coil.

BACKGROUND OF THE INVENTION

There is currently a large effort devoted to the miniaturization of unmanned aerial vehicles (UAVs). Through rapid advancement in the miniaturization of essential elements such as inertial measurement units, sensors, and power supplies, Micro Air Vehicles (MAVs) have become a reality. However, little research has focused on the miniaturization of control surface actuators. Instead, MAV developers have used hobby-quality actuators. These actuators are typically too big, too heavy, too slow, inefficient and unreliable for use in MAVs. Therefore, there exists a need for reliable actuators that are designed to address the following issues: size, weight, bandwidth, torque, reliability, voltage, rate and position saturation.

The next generation of MAVs are described by the Defense Advanced Research Projects Agency (DARPA) as being less than 15 cm in length, width or height. This physical size renders this class of vehicle at least an order of magnitude smaller than any missionized UAV developed to date. Equally as important, the weight of the actuators should account for less than 5% of the total weight of the vehicle. Lincoln Lab investigated one example of a vehicle of this type. For a ten-gram concept vehicle, propulsion not only consumed 90 percent of the power, but also 70% of the weight budget. The remaining 30% of the weight budget accounted for the control surface actuators, as well as the flying structure, camera, atmospheric sensor array, and other avionics systems.

Past efforts to conform to MAV standards, such as Aerovironment's Black Widow, have approached DARPA's requirements with the flying wing approach. The flying wing achieves long flight duration; however, its low chord Reynolds number airfoils (30,000 to 70,000) operate in an aerodynamic regime far from the predictable aerodynamics of larger vehicles. The flying wing is highly susceptible to wind shear, gusts and roughness produced by precipitation. To achieve flight stability in this aerodynamic environment, the MAV must be capable of rapid actuation or have a high bandwidth. Intimately connected to the bandwidth, the torque requirement consists of maintaining an aerodynamic control surface in place. The actuators must not only be capable of rapid acceleration, but must also have adequate travel and peak angular velocity, thus satisfying the rate and position saturation requirements for MAV control surface actuation.

There are several approaches to determining the best actuator for MAVs. The current approach relies on available commercial off-the-shelf actuators. Given the current state of technology, many possible options, though substandard, exist to fulfill the microactuation requirements of MAVs. Among the possibilities are packaged servos, commercial motors, voice coil motors, HDD microactuators, and nanomuscles.

The first option is servo actuators. However, low bandwidth is the main drawback with packaged servo actuators. The approach in these actuators is to minimize the weight by using the smallest high-speed motors available, then gearing the speed down through an array of plastic gears while at the same time increasing the torque. In general, the equivalent motor inertia and frictional force on the driven shaft side increases by a factor of the gearing ratio squared, further reducing bandwidth. Such gearing not only introduces power loss, but also introduces backlash. Backlash causes unexpected dynamics in systems, such as the control surface for an aerial vehicle, which requires precise position control and undergoes frequent change in direction.

Further, the torque provided by commercial hobby servos is more than necessary for MAVs. Saturation occurs at relatively low speeds because the official specifications for these actuators do not indicate bandwidth; rather, the time for the actuator to travel 60 degrees is given. Such a degree of mismatch in performance requirements is unacceptable in a system with extremely tight size, weight and performance requirements.

Rather than using cased servos, using motors directly for actuation is another option. The advantage is that motors can be made very small. In particular, Faulhaber and Smoovy produce motors on the 2 and 3 mm scale. The overall disadvantage is that the motors are built for continuous operation and very high velocity at the expense of torque. This necessitates some form of transmission, and therefore, power losses and backlash between the motor and the final drive stage occur. Another drawback is that the very smallest motors are brushless polyphase devices, which require external controls.

Nanomuscles are linear actuators commercially manufactured near the size factor required for MAV applications. Nanomuscles are attractive devices for microactuation because they are small, light, and are capable of very large forces over adequate stroke (4 mm). The major drawback, however, is that the actuation time is about one-half of a second. Another drawback is that the nanomuscles are only capable of contraction, thus requiring two units for full actuation.

Among the many types of actuators such as speakers, rotary, etc., the voice coil actuator family also encompasses hard disk drive (HDD) actuators. The boom of the computer industry pushes for continual improvements in HDD actuators. The goal of the HDD manufacturers is higher data storage capacity achieved through increased head position resolution and bandwidth. The most common method for high bandwidth HDD actuation is the combination of a high travel, low-resolution voice coil actuator in series with a low travel, high-resolution microactuator.

The voice coil alone achieves high bandwidth through direct drive actuation and low arm inertia. The force of actuation in voice coil motors, as in all direct drive motors, is purely electromagnetic; the only source of friction is the support bearing for the arm or object being moved. The main drawback to the voice coil design is the heavy weight of non-moving components. For data storage, overall weight reduction is not a vital requirement; therefore, only portions of the magnetic field and current are used at any given time for actuation.

Among the most common microactuators are those used on the tips of read heads for HDDs. These microactuators are divided into two families: piezo and electrostatic. Advantages of these actuators include a high bandwidth on the order of kilohertz and a very lightweight and small package.

On the other hand, the actuator is so small that the effective stroke only extends on the order of micrometers. Another drawback to HDD microactuators for MAVs is that both piezo and electrostatic slider actuators require near 80 Volts for full travel. Piezoelectric multilayer bender actuators provide higher travel on the order of a millimeter; however, they still require high voltages.

SUMMARY OF THE INVENTION

The present invention provides a high intensity radial field (HIRF) magnetic array and actuator employing direct drive technology, which operates particularly well in micro scale applications.

A nested magnetic array consistent with the invention comprises an outer magnet with a magnetization pointing in an axial direction; a middle magnet with a radial magnetization which is pointed either concentrically inward or outward and is perpendicular to the magnetization of the outer magnet; and an inner magnet with a magnetization pointed anti-parallel to the magnetization of the outer magnet.

In one embodiment, a permanent magnet actuator comprises a first magnetic array comprising nested outer, middle and inner cylindrical magnets, wherein the outer annular magnet of the first magnetic array has a magnetization pointing in an axial direction, the middle annular magnet of the first magnetic array has a radial magnetization which is pointed either concentrically inward or outward and is perpendicular to the magnetization of the outer annular magnet, and the inner cylindrical magnet of the first magnetic array has a magnetization pointed anti-parallel to the magnetization of the outer annular magnet; and a conductive coil having a current located within the volume of conductor, wherein the magnetic field of the first magnetic array is substantially radial and perpendicular to the current located in the conductive coil. The conductive coil may be located above or below the first magnetic array, depending upon the magnetization direction of the magnets in the magnetic array.

In another embodiment, a permanent magnet actuator further comprises a second magnetic array comprising nested outer, middle, and inner cylindrical magnets, the second magnetic array being located on the opposite side of the conductive coil from the first magnetic array, wherein the outer annular magnet of the second magnetic array has a magnetization pointing in an axial direction parallel to the direction of the magnetization of the inner cylindrical magnet of the first magnetic array, the middle annular magnet of the second magnetic array has a magnetization in the same direction as the middle magnet of the first magnetic array, and the inner cylindrical magnet of the second magnetic array has a magnetization anti-parallel to the magnetization of the outer annular magnet of the second magnetic array; wherein the conductive coil is disposed between the first and the second magnetic arrays, and wherein the magnetic field of the first and the second magnetic arrays is perpendicular to the current located in the conductive coil. The coil may comprise at least one wire having a plurality of turns.

In method form, a method for creating a magnetic force comprises creating a magnetic field engulfing a conductive coil, the magnetic field comprising the superposition of a first magnetic field curling from an inner ring of a magnetic array to an outer ring of the magnetic array, and a second magnetic field pointing radially outward from a middle ring of the magnetic array; and applying a current through the conductive coil.

The conductive coil may have a winding that is variously configured, e.g., pancake-shaped, solenoidal, or toroidal. The coil may comprise more than one winding (e.g., two windings wound in opposing directions) for use, e.g., in a two degree-of-freedom actuator, with independently controlled orthogonal axes.

Further, in an exemplary actuator consistent with the present invention, the arrays may be canted to permit the toroidal winding to expand, affording control over the spread of the magnetic field in the gap.

DETAILED DESCRIPTION OF THE INVENTION

Figure 1:
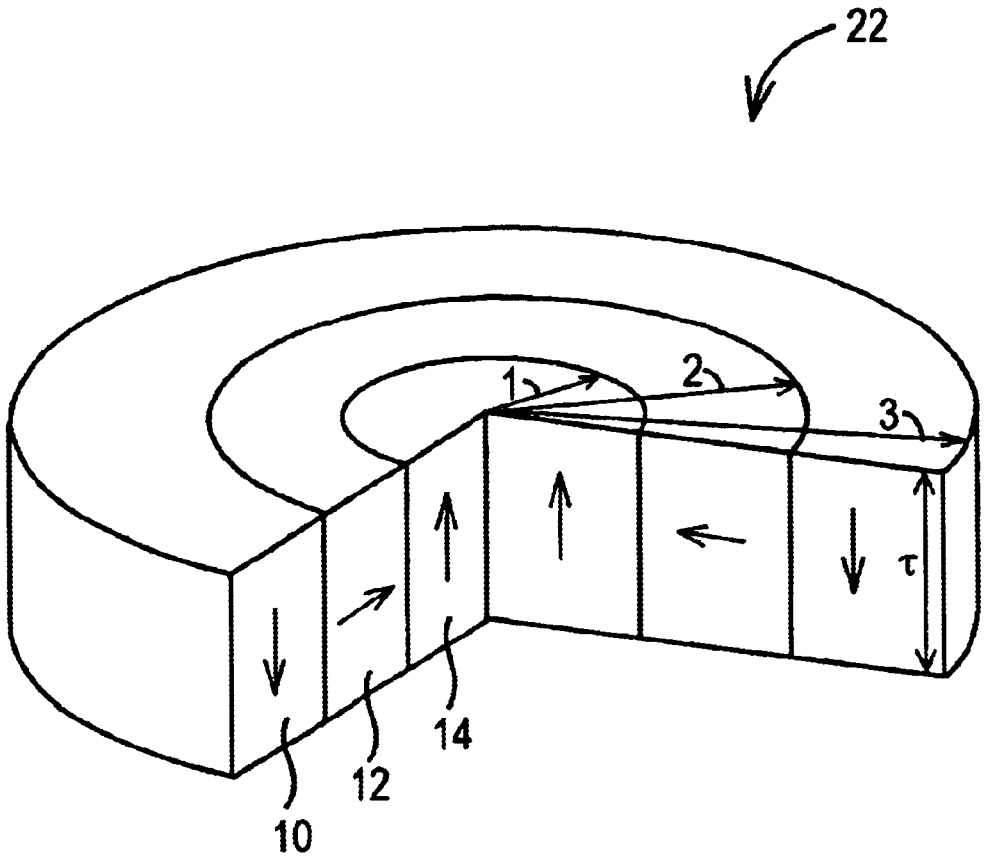
FIG. 1 is a partial cutaway schematic view of an exemplary HIRF permanent magnet array consistent with the present invention.

FIG. 1 is a schematic view of an exemplary high intensity radial field (HIRF) magnetic array 22 consistent with the present invention. The HIRF magnetic array 22 comprises two nested annular magnets 10, 12 and an inner cylindrical magnet 14, which could also be annular, which are magnetized in the orientations shown in FIG. 1 or in their opposite orientations, respectively. The outer annular magnet 10 has a magnetization pointing axially out of the bottom of the array; the magnetization of the middle ring 12 is perpendicular to the magnetization of the outer ring 10 and points in the inward radial direction; and the magnetization of the inner cylinder 14 points anti-parallel to the outer ring, i.e., out of the top of the array. Magnets 10 and 14 are always anti-parallel to each other and may be magnetized in the opposite directions, and the middle annular magnet 12 may be magnetized in either radial direction—in both cases, depending on the side axially where the magnetic field is to be intensified.

Figure 9:
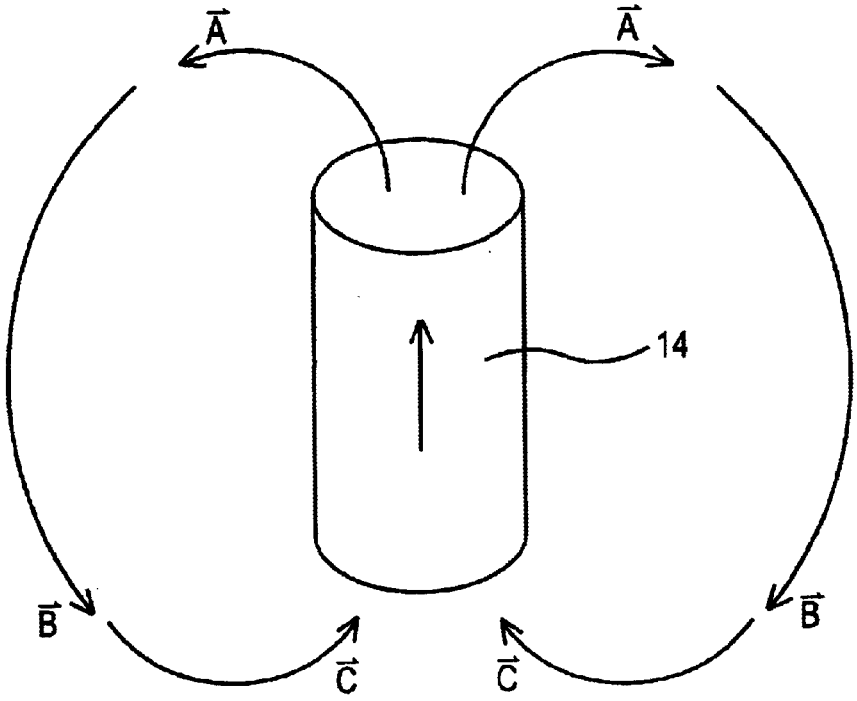
FIG. 9 is a side view of the inner magnet of an exemplary HIRF permanent magnet array consistent with the present invention, illustrating the magnetic field lines created by the magnetization of the inner cylinder.
Figure 10:
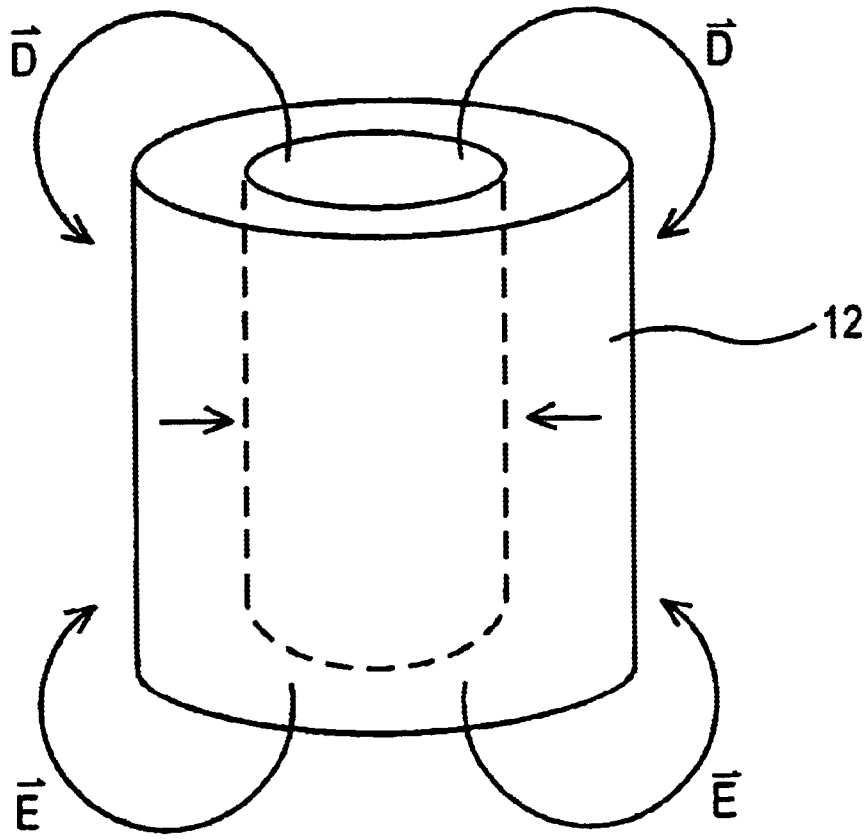
FIG. 10 is a side view of the middle annular magnet of an exemplary HIRF permanent magnet array consistent with the present invention, illustrating the magnetic field lines created by the magnetization of the middle ring.
Figure 11:
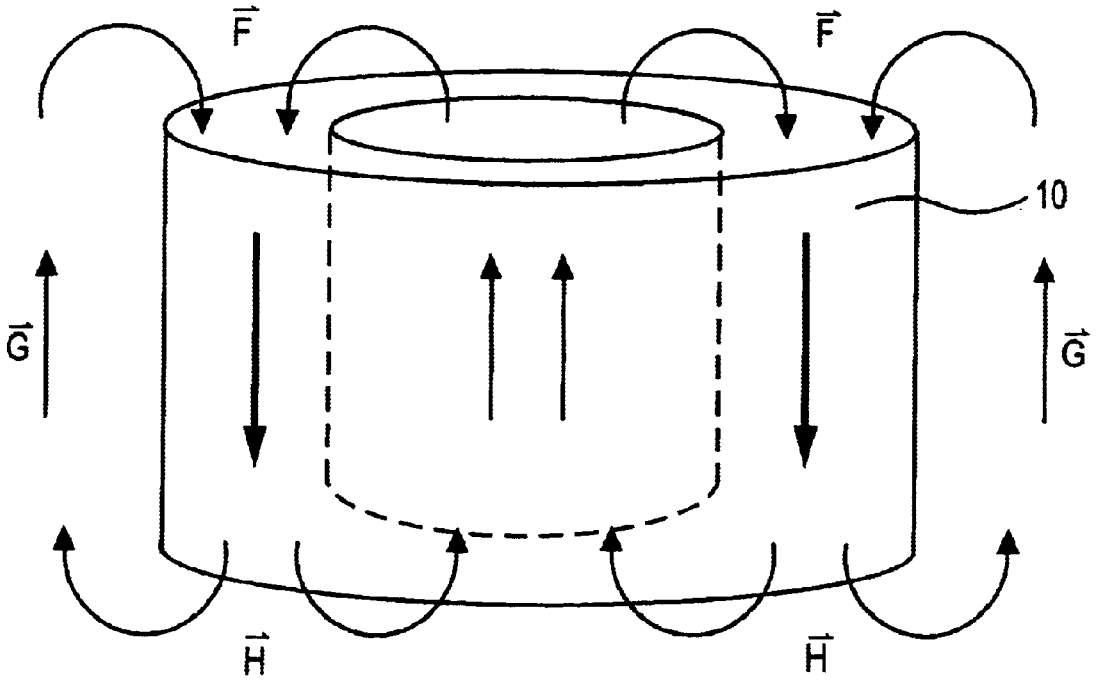
FIG. 11 is a side view of the outer annular magnet of an exemplary HIRF permanent magnet array consistent with the present invention, illustrating the magnetic field lines created by the magnetization of the outer ring.

The magnetic fields created by each of the three nested magnets are shown in FIGS. 9–11. FIG. 9 shows the direction of the magnetic field lines created by the inner cylinder 14. The magnetic field for the inner cylinder 14 points vertically upward inside the cylinder 14 and curls around to the outside of the cylinder 14 from the top to the bottom as represented by vectors A, B, and C.

FIG. 10 shows the magnetic field of the middle annular magnet 12. The magnetization points radially inward inside the ring 12. The direction of the magnetic field outside the ring 12 is represented by vectors D and E.

The magnetic field of the outer annular magnet 10 is illustrated in FIG. 11. The magnetization of the outer ring 10 is vertically downward. The direction of the magnetic field is represented in FIG. 11 by vectors F, G and H.

Figure 2:
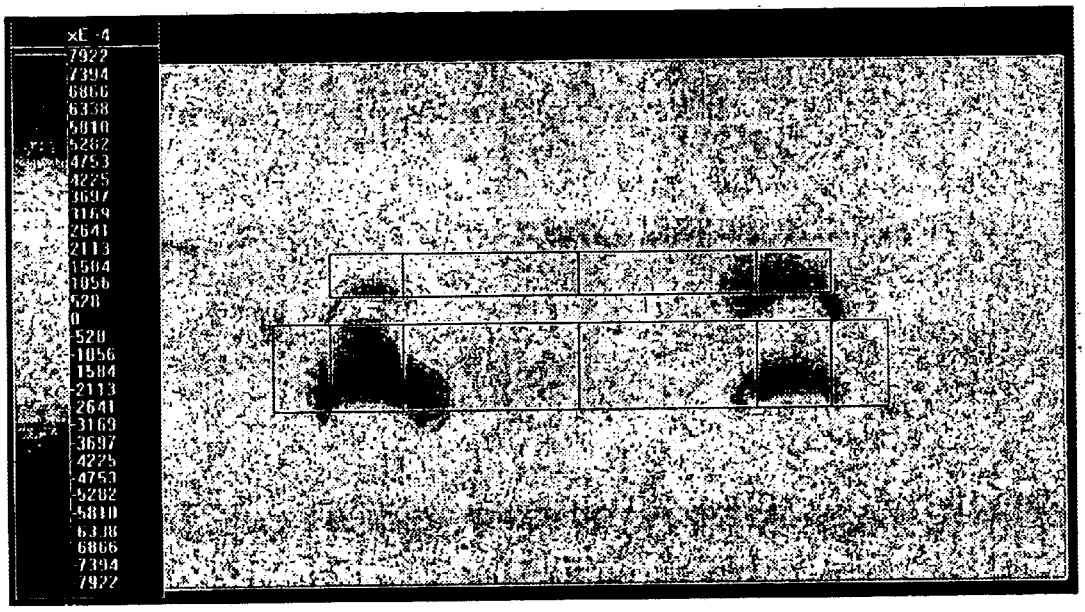
FIG. 2 is a plot illustrating the radial (horizontal) magnetic field intensity from an exemplary permanent magnet array consistent with the present invention.
Figure 3:
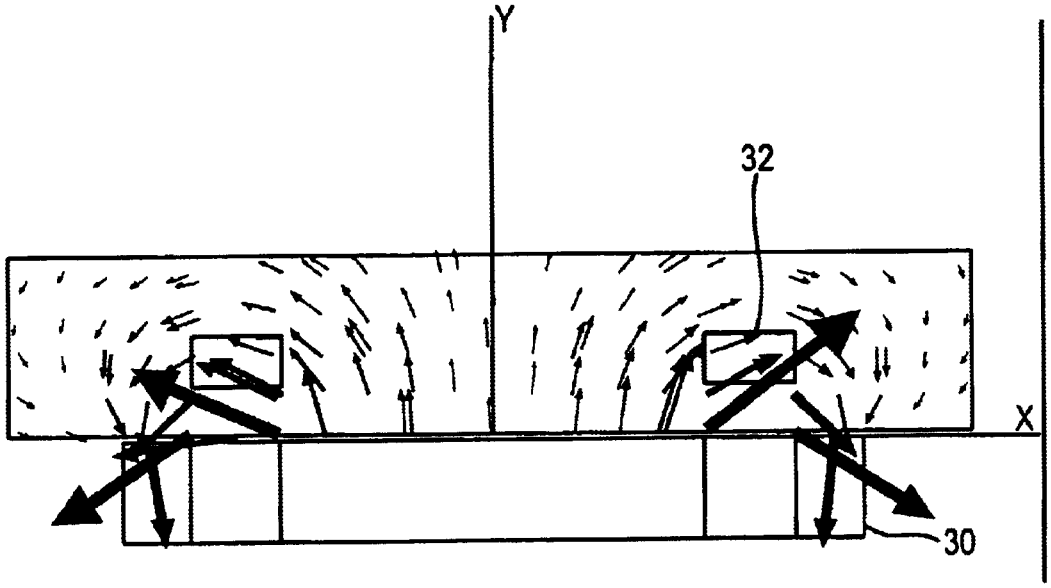
FIG. 3 is an arrow plot illustrating the radial magnetic field orientation above an exemplary magnetic array consistent with the present invention in the conductive coil region, wherein the lower rectangle is the magnetic disk array seen from the edge, and the upper rectangle is the conductive coil seen from the edge.

Superposing the fields of the three magnets 10, 12, 14 will produce the manetic field of the magnetic array 22 shown in FIGS. 2 and 3. Vectors A, D and F represent the fields of the three magnets 10, 12, 14 above the array, respectively. These three vectors are all pointing in the same direction above middle magnet 12, and therefore, the magnetic fields add together to create a high intensity magnetic field pointing radially outward. Vectors B and G represent the magnetic field along the side of the array 22. These two vectors are pointing in opposite directions and thus partially cancel one another. Finally, vectors C, E and H represent the field of each magnet 10, 12, 14 below the array. The field E of the middle ring 12 points in the opposite direction from the fields C, H of the two other rings 10, 14. Therefore, there is a partial cancellation of the magnetic field in this area. Consequently, only a very weak magnetic field exists below the array 22.

The key concept is the vectorial addition of fields increasing the radial field above the array while decreasing the radial field below the array. By reversing the magnetization of the middle magnet, the high magnetic field can be shifted from above to below the array. Alternatively, the magnetization vectors of both the inner and outer magnets could be reversed to control the location of the large radial magnetic field.

A specific advantage of this magnet configuration is the shifting of magnetic field from unused space away from the conductor to where a conducting coil is situated. This results in an efficient usage of the total magnetic field from the permanent magnets. FIG. 2 shows the intensity of the radial (horizontal) component of the magnetic field. It should be noted that the magnetic field is strong where a coil is above the magnetic array, while comparatively non-existent below the array.

Figure 5:
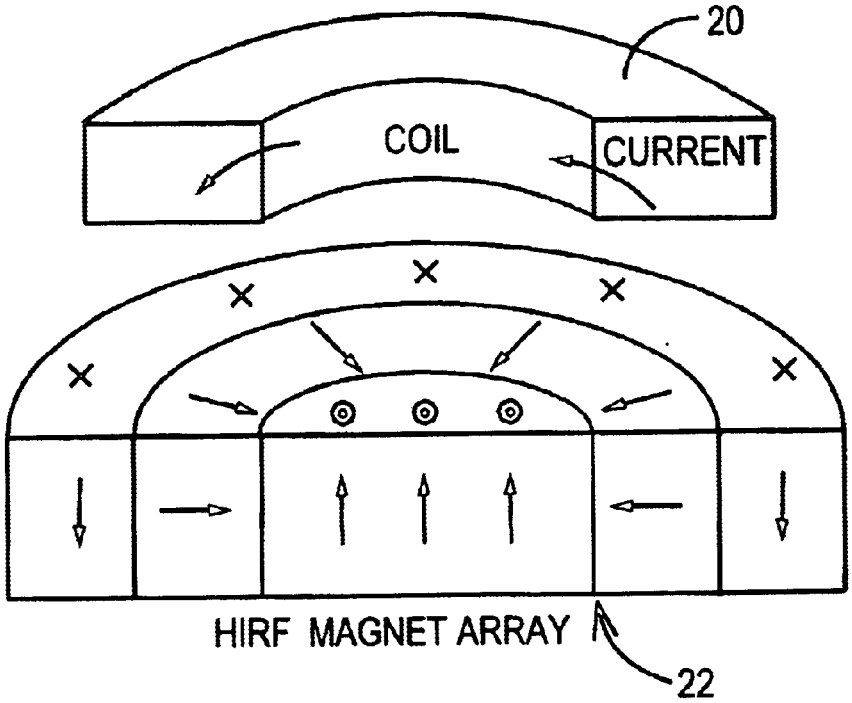
FIG. 5 is a schematic 3-D cut-away view of an exemplary actuator consistent with the present invention.

In one embodiment, this exemplary HIRF magnetic array 22 may be combined with such a conductive coil 20 to form a HIRF actuator, as illustrated in the exemplary actuator of FIG. 5. The coil 20 is simply a hoop with multiple turns of wire and may have an average radius equal to the average radius of the middle, radially-magnetized magnet 12. Because the radial field is always orthogonal to the conductive coil, there are no unused end turns, thus increasing the actuator's ohmic efficiency. All the current in the conductor contributes to moving the coil axially toward or away from the magnetic array, dependent upon the direction of the current.

Figure 12A:
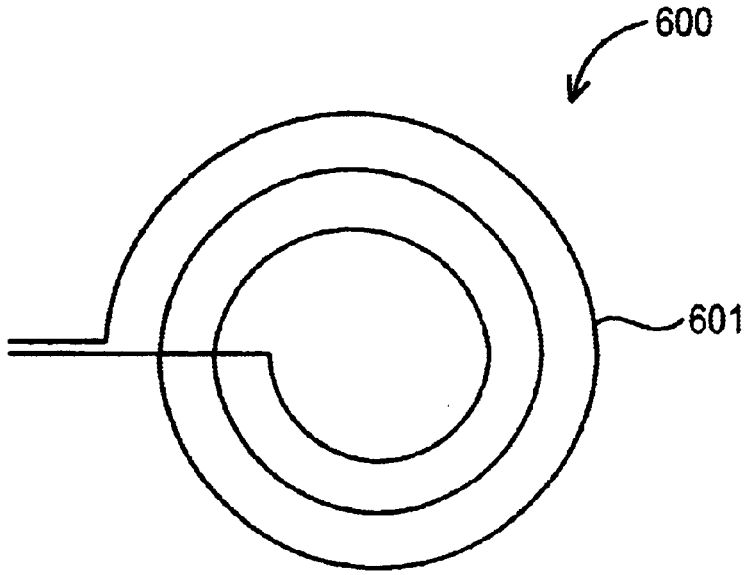
FIG. 12A is a top view of an exemplary conductive coil consistent with the present invention, having a pancake-shape winding.
Figure 12B:
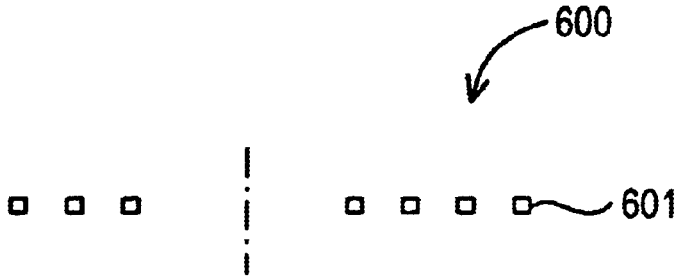
FIG. 12B is a side cross-sectional view of the exemplary conductive coil of FIG. 12A.
Figure 13A:
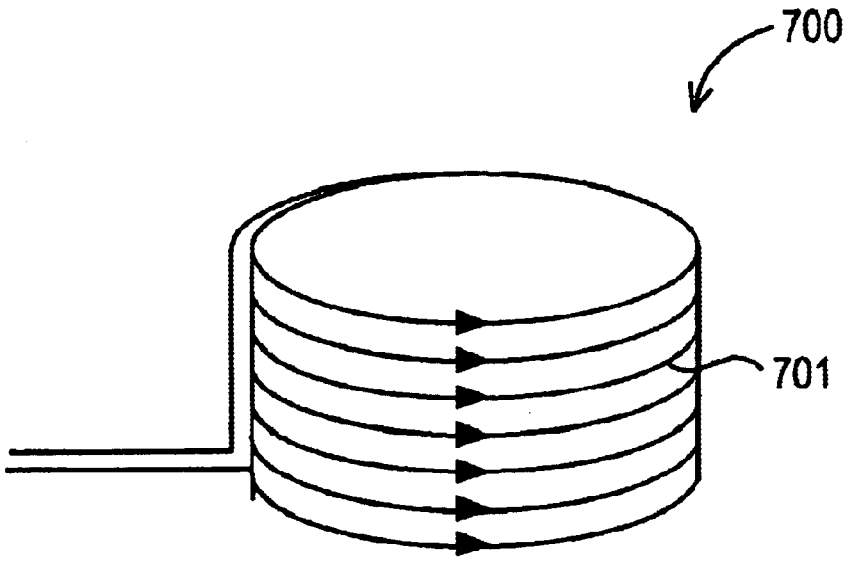
FIG. 13A is an oblique view of another exemplary conductive coil consistent with the present invention, having a solenoidal winding.
Figure 13B:
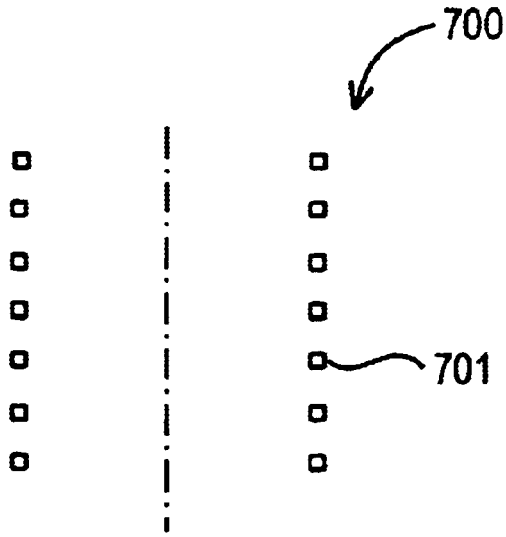
FIG. 13B is a side cross-sectional view of the exemplary conductive coil of FIG. 13A.

Turning now to FIGS. 12A and 12B, one exemplary coil winding 600 is illustrated, wherein the coil 600 has a plurality of turns of wire 601 and has a pancake-shaped winding. Alternatively, as illustrated in FIGS. 13A and 13B, another exemplary coil winding 700 is illustrated, wherein the coil 700 has a plurality of turns of wire 701 and has a solenoidal winding.

Another important aspect of the magnet array is that the field extends radially above the magnets, as illustrated in FIG. 3, an arrow plot of the magnetic field orientation above the magnetic array in the conductive coil region, wherein the lower rectangle 30 represents the magnetic array 22 and the upper rectangle 32 represents the conductive coil 20. As shown in FIG. 3, in this exemplary embodiment of the present invention, the magnetic field curls from the inner magnetic field through the conductive coil into the outer ring. If the first magnetic field curls outward from the inner ring to the outer ring, then the second magnetic field should also point radially outward, i.e., the middle magnet magnetization is radially inward and its magnetic field outside the magnet is outward.

Figure 4:
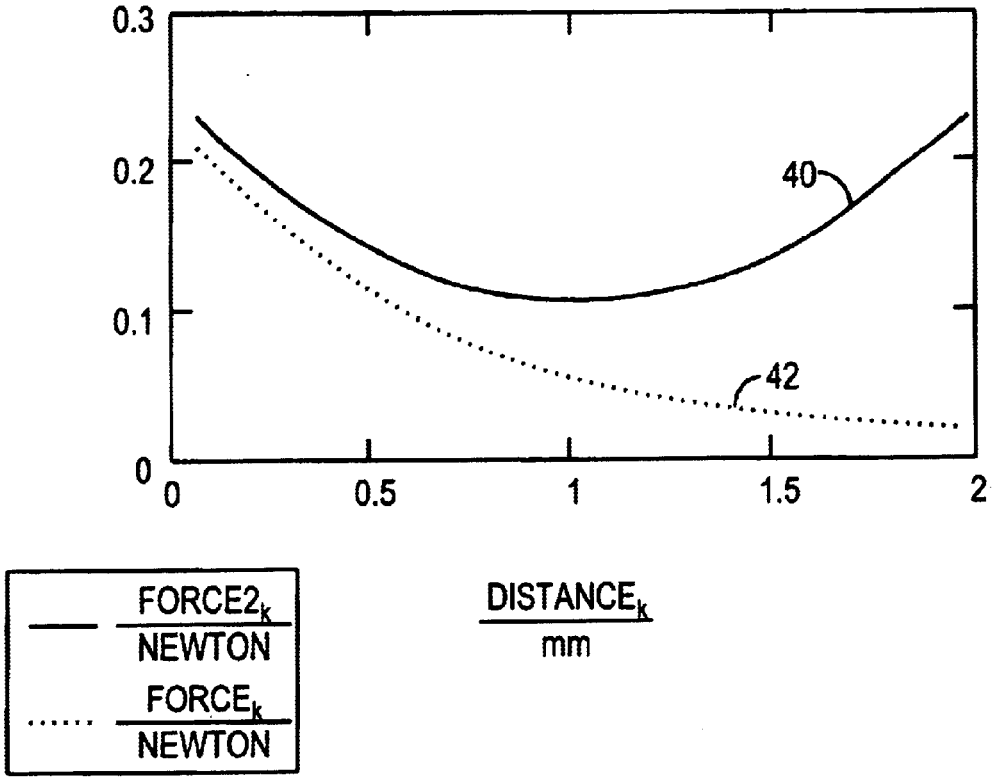
FIG. 4 is a graph illustrating force over distance away from the magnetic array surface in an exemplary actuator consistent with the present invention, wherein $\text{Force}_k$ corresponds to the force with one magnetic array in use, and $\text{Force2}_k$ corresponds to the force with first and second magnetic arrays in use.
Figure 6:
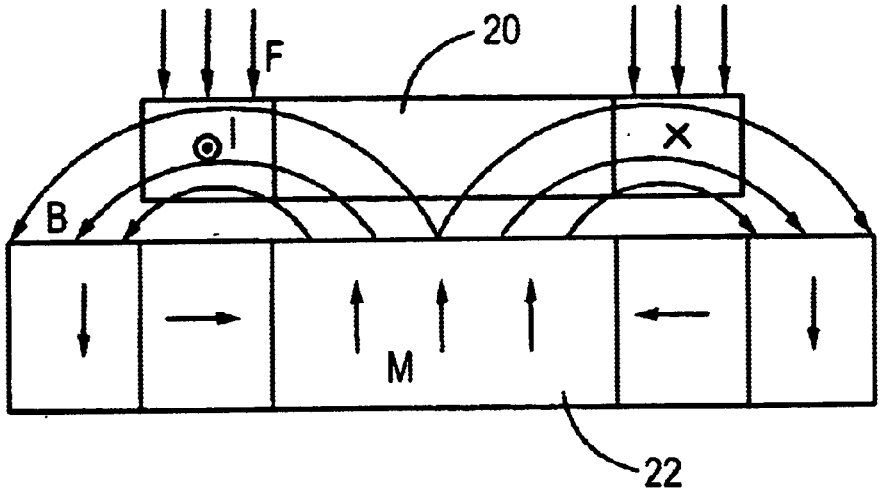
FIG. 6 is a side sectional view of the actuator of FIG. 5, showing HIRF magnetization, magnetic field, current and force direction.

The magnetic field shown in FIG. 3 can be used with the Lorentz force law to calculate the direction of the force on the conductive coil. The Lorentz Force law states that $F=qv*B$, where q is the charge, v is the velocity of the charge, and B is the magnetic field. In the left portion of the coil, as illustrated in the exemplary embodiment of FIG. 6, the direction of the current I originates from the page (toward the reader hereof), and the magnetic field lines B curl from right to left. Thus, using Lorentz force law and the right-hand rule, the magnetic force F pushes the conducting coil 20 toward the magnetic array 22. Similarly, on the right side of the coil 20, the current flows into the page (away from the reader hereof), and the magnetic field curls from left to right, therefore creating a downward force. Line 42 of the graph of FIG. 4 shows the magnitude of the force on the coil 20 with respect to distance away from a single magnet array for a given current. The stroke of this actuator is dependent on the maximum distance between the coil 20 and magnetic array 22 in which a significant force can still be applied.

Those skilled in the art will recognize that, although the foregoing embodiment describes a HIRF actuator with reference to a magnetic array below the coil, the magnetic array could, alternatively, be located on either side of or above the conductive coil.

Figure 7:
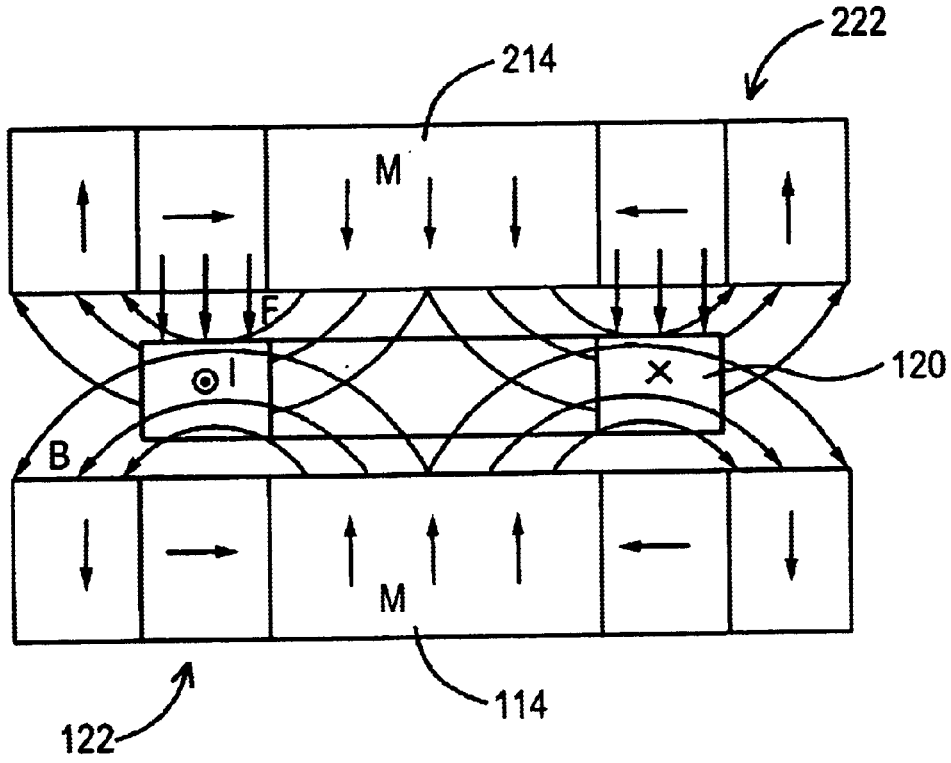
FIG. 7 is a side sectional view of an exemplary actuator having first and second magnetic arrays, in another embodiment of the present invention.

As shown in FIG. 7, in another embodiment of the present invention, both a top and bottom magnetic array are utilized for a greater radial magnetic field, and hence, a greater axial force per unit current. In the embodiment shown in FIG. 7, a top magnetic array 222 is disposed above the conductive coil 120, and a bottom magnetic array 122 below the coil 120. The top magnetic array 222 is magnetically inverted with respect to the bottom array 122. That is, the top magnetic array 222 is positioned so that the direction of the magnetic field in the top inner coil 214 is anti-parallel to the magnetic field in the bottom inner coil 114. Therefore, as seen in FIG. 7, the radial magnetic field from the top magnetic array 222 reinforces the radial magnetic field of the bottom array 122. This creates a greater force per unit current. Line 40 of FIG. 4 shows how the force varies over distance for this exemplary embodiment of the invention.

Figure 8:
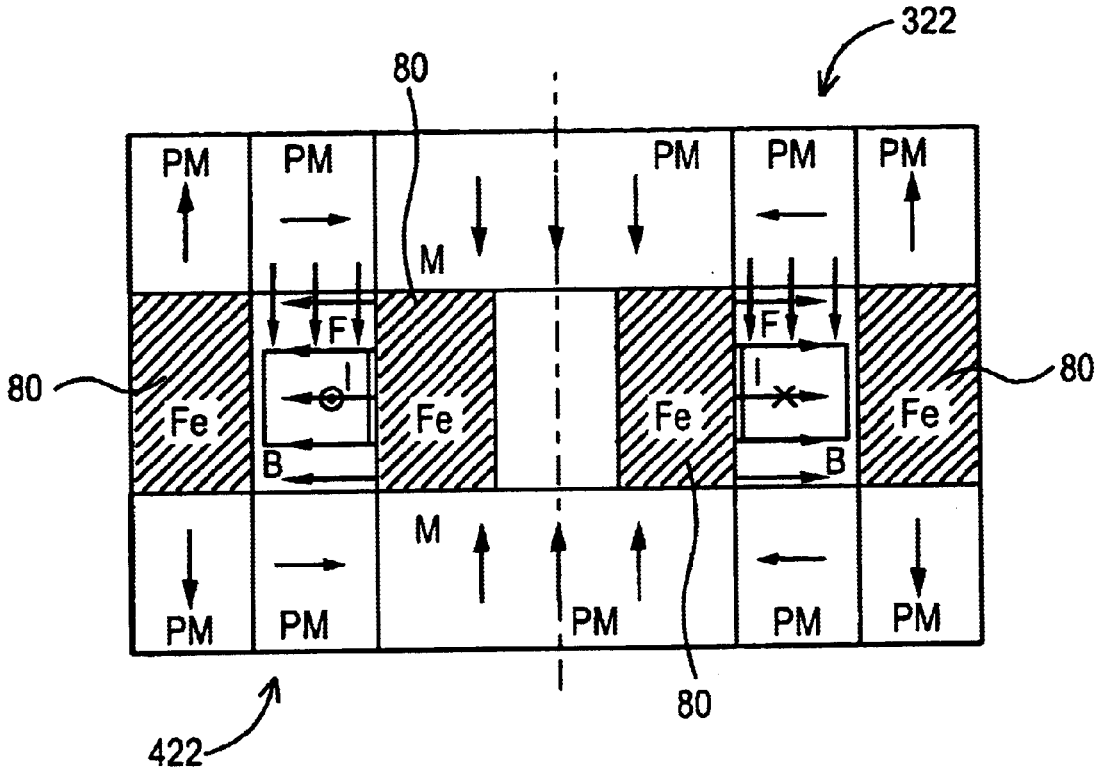
FIG. 8 is a side sectional view of an exemplary actuator in another embodiment of the invention, with ferromagnetic flux posts.

As shown in FIG. 8, in certain embodiments of the present invention, one or more annular ferromagnetic flux posts 80 may be disposed between top 322 and bottom 422 magnetic arrays. The annular flux posts 80 are used to increase and control the radial magnetic field, as a function of position in the gap. Accordingly, the surface of the posts may be shaped in a known manner similar to magnetic pole faces, e.g., annular in shape, to optimize the magnetic field distribution within the gap. Thereby, the actuator response is made more linear than it would be without the flux posts 80, which aid in shaping the flux. Those skilled in the art will recognize that an actuator arm (not shown) may be adapted to penetrate the flux posts according to known techniques.

The magnets described herein may comprise rare earth magnets, e.g. NdFeB or SmCo. Since magnetic field superposition is a consideration, ceramic and AlNiCo magnets may be less desirable for some applications, as they do not have substantially linear responses (e.g., as compared to NdFeB). However, since ceramic magnets are linear over a portion of their operating curve, they may have potential utility in certain non-critical embodiments of the invention, e.g. actuators for toys.

Figure 14:
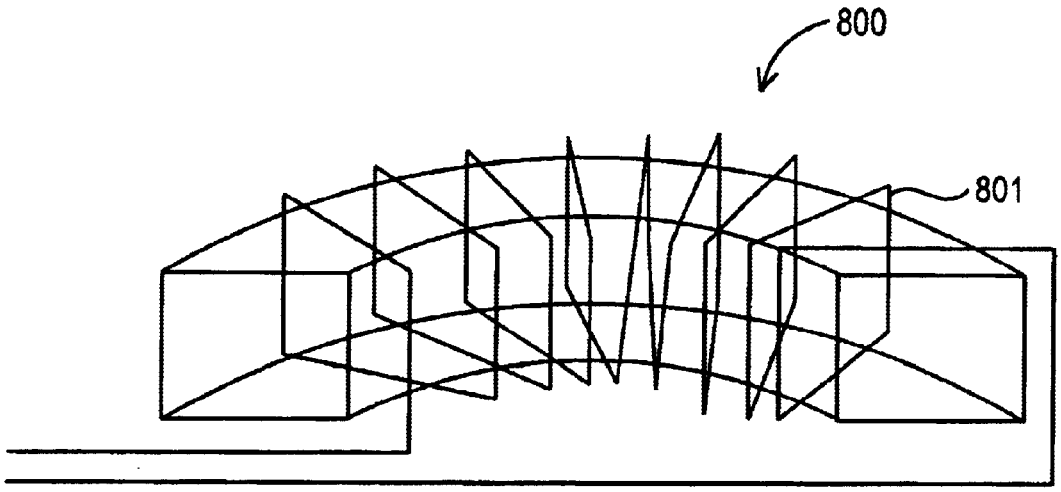
FIG. 14 is a side cross-sectional view of still another exemplary conductive coil consistent with the present invention, having a toroidal winding.

With reference to FIG. 14, in a third exemplary coil winding embodiment, the coil 800 has a plurality of turns of wire 801 and has a toroidal winding. This toroidal winding creates different forces than either of the pancake-shaped or solenoidal windings described above.

The Lorentz force is dependent upon the vector cross-product of the current and the magnetic field, $\vec{F}=\int I\,\vec{d1}\times\vec{B}$. The cylindrical Halbach magnet array described produces magnetic field of the form ($B_r$, 0, $B_z$). For a pancake or solenoid winding, the coil vector $I\,\vec{d1}$ is of the form (0, $I\,d1_\theta$, 0). Therefore, as is well known to those skilled in the art, the force is $\vec{F}=\hat{r}(J_\theta B_z)+\hat{\theta}(0)+\hat{z}(J_\theta B_r)$. The radial force component generally integrates to zero leaving the axial force as the major force component.

For a toroidal winding, within the magnetic field of the array the coil vector $I\,\vec{d1}$ is of the form ($I\,d1_r$, 0, $I\,d1_z$). Therefore, the force is:

$$\vec{F}=\hat{r}(0)+\hat{\theta}(I\,d1_r B_z-I\,d1_z B_r)+\hat{z}(0).$$

This force creates a torque about the z-axis, $T_z=r\,I\cdot(B_z d1_r-B_r d1_z)$.

It is noted that a toroid with N turns about the minor axis (poloidal axis) executes a single turn about the major axis (toroidal axis). This single turn would produce an axial force according to the first embodiment. Controlling N allows the ratio between the axial force and torque to be varied.

Figure 15:
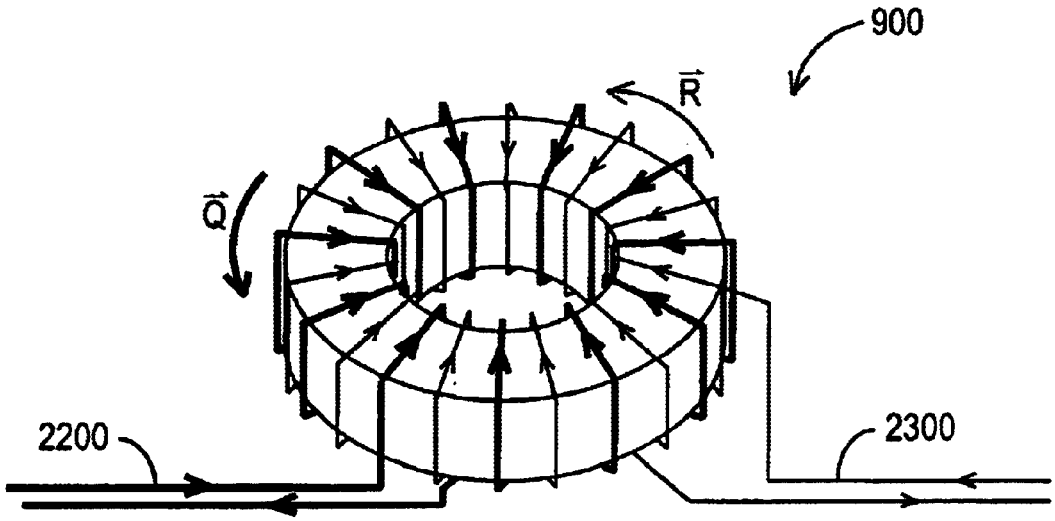
FIG. 15 is an oblique sectional view of yet another exemplary conductive coil consistent with the present invention, having a toroidal winding and having utility in an exemplary two degree-of-freedom acutator.

Turning now to FIG. 15, an exemplary conductive coil 900 consistent with the present invention is illustrated, comprising two toroidal windings 2200, 2300. The windings 2200, 2300 are wound concentrically such that they have the same poloidal sense but opposite toroidal sense, with N=11. Then, a positive current in winding 2200 is in the same poloidal direction as winding 2300, and the respective torques Q, R add vectorially, producing twice the torque of a single winding. The toroidal currents, however, cancel, thereby producing no axial force. This is the state shown in FIG. 15. Alternatively, if a positive current is introduced in winding 2200 but a negative current is introduced in winding 2300, then the torques Q, R tend to cancel, and the axial forces add. Hence, a two degree-of-freedom (2 DOF) actuator results, with independently controlled orthogonal axes. Clearly, any even number of windings can be evenly split in such a manner (i.e., half of the windings wound one way, the other half the other way).

Exemplary dimensions of a magnetic array (e.g., as shown in FIG. 1) used in an HIRF actuator for MAVs consistent with the present invention may be as follows: an inner magnet having a radius $r_1$=2 mm and a height of 1 mm; a middle magnet having an inner radius=$r_1$, an outer radius $r_2=r_1$=0.83 mm, and a height of 1 mm; and an outer magnet having an inner radius=$r_2$, an outer radius $r_3=r_2$+0.63 mm, and a height of 1 mm. Here, the coil dimensions may be: inner radius=$r_1$, outer radius=$r_1$+0.83 mm, and a height t=0.5 mm. It should be noted that the flux area of the three magnets is desirably constant (although not necessary), and the flux areas may be described by the following equations:

$$A1=\pi^* r_1^2(\text{top})$$

$$A2=2^*\pi^* r_1{}^* t(\text{side})$$

$$A3=\pi^*(r_3^2-r_2^2)(\text{top})$$

where A1=A2=A3.

Further, the (vertical) gap between opposing magnet arrays is Z=1.6 mm, the ampere-turns of the coil are NI=100 amps. By magnetic field analysis, the radial flux density at the center of the conductor is B_rad=0.45 Tesla, and the corresponding Lorentz (vertical) force is 0.68 Newtons=F=NI*L*B_rad, where $L=2^*\pi^*(r_1+(r_2-r_1)/2)$ is the length of the center of the conductor. The stroke is Z−t=1.1 mm.

It should be understood that the aforementioned geometry and dimensions are merely exemplary, and it is contemplated that the present invention covers other embodiments of arrays, actuators, and actuation systems not specifically illustrated or described herein, having alternative geometries. For example, while the coil dimensioned as described above may produce a high level of heat and therefore be suitable for an aerodynamic application (e.g., high forced convection) or a duty cycle of 10% or less, it should be recognized that alternative coil sizes may be selected based on factors such as desired thrust (force) and heating.

Figure 16:
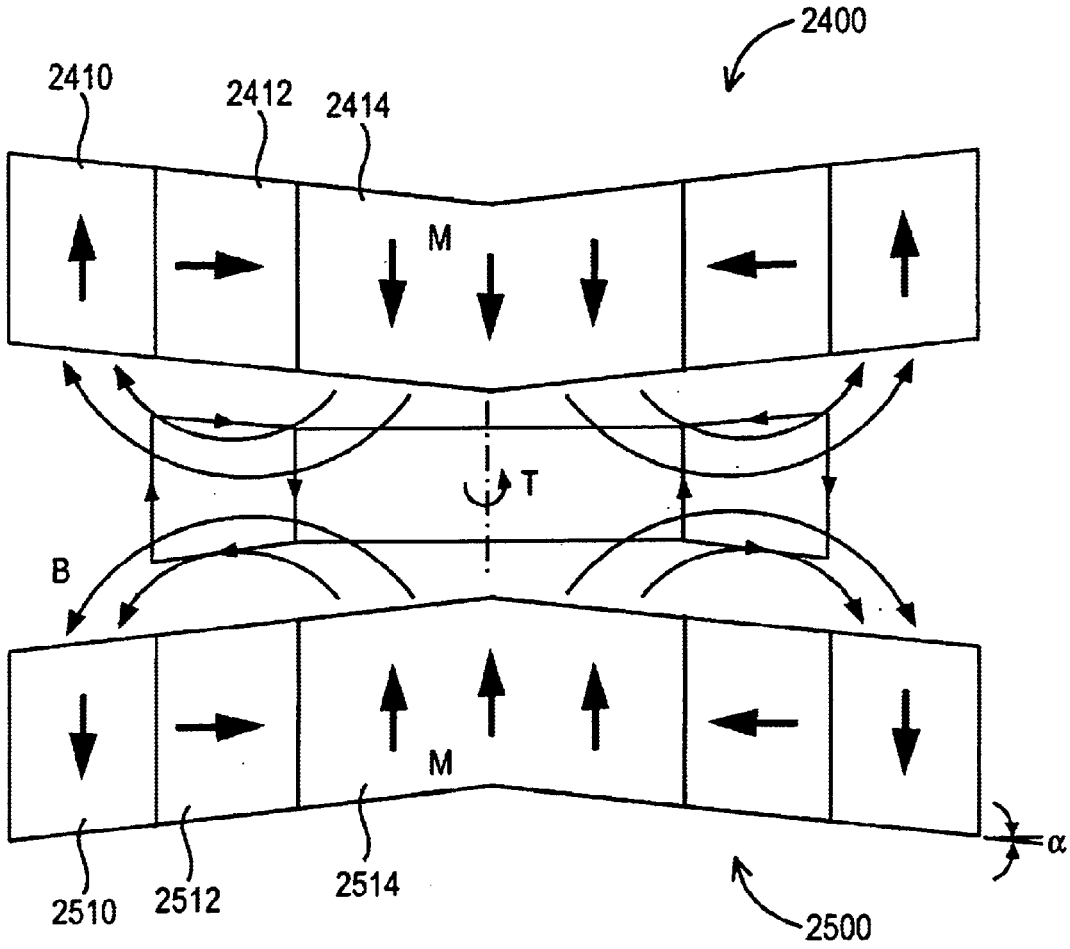
FIG. 16 is a side cross-sectional view of a plurality of exemplary canted magnetic arrays consistent with the present invention, disposed as in an exemplary actuator.

With reference now to FIG. 16, in yet another embodiment of the present invention, a plurality of canted magnetic arrays 2400, 2500 consistent with the present invention are illustrated, disposed as in an exemplary actuator. Each array 2400, 2500 has inner 2414, 2514, middle 2412, 2512, and outer 2410, 2510 magnets. In this embodiment, the surface of each magnetic array 2400, 2500 is angled (at an angle $\alpha$) to permit the toroidal winding to expand. This affords the designer some control over the spread of the magnetic field in the gap using the magnetic field characteristics associated with the Maxwell equation $\nabla\cdot B=0$. The angle $\alpha$ may be positive or negative.

Those skilled in the art will recognize that the inner magnet of an array consistent with the present invention may be either an annular or cannulated member (i.e., hollow), or alternatively, a solid cylindrical member. A magnetic array consistent with the invention having an inner magnet that has an aperture along its central axis may be adapted for fixation to another component as is part of an actuation system, wherein a J-shaped "umbrella" hook disposed within the aperture may be used to mount the array and/or coil. Of course, it is contemplated that other mounting means could alternatively be used for fixation of the array.

The foregoing embodiments are intended to be illustrative and not limiting. Numerous other embodiments will be apparent to those skilled in the art. All such alternative embodiments are included in the broad principle of the invention, as defined in the following claims.

What is claimed is:

1. A nested magnetic array comprising:

an outer magnet having a magnetization pointing in an axial direction;

a middle magnet having a radial magnetization substantially perpendicular to the magnetization of said outer magnet; and an inner magnet having a magnetization directed substantially anti-parallel to the magnetization of said outer magnet.

2. The magnetic array of claim 1, wherein the inner magnet, middle magnet, and outer magnet are cannulated.

3. The magnetic array of claim 1, wherein the inner magnet, is a solid member.

4. The magnetic array of claim 1, wherein the inner magnet, middle magnet, and outer magnet are made from NdFeB.

5. The magnetic array of claim 1, wherein the inner magnet, middle magnet, and outer magnet are made from SmCo.

6. A permanent magnetic actuator comprising:

a first magnetic array comprising nested outer and middle magnets and an inner magnet, wherein the outer magnet of said first magnetic array has a magnetization pointing in an axial direction, the middle magnet of said first magnetic array has a radial magnetization, and the inner magnet of said first magnetic array has a magnetization directed substantially anti-parallel to the magnetization of said outer magnet; and a conductive coil having a current distributed over the volume of said conductive coil, wherein the magnetic field of said first magnetic array is substantially perpendicular to said current in said coil.

7. The permanent magnetic actuator of claim 6, wherein said conductive coil is located below said first magnetic array.

8. The permanent magnetic actuator of claim 6, wherein said conductive coil is located above said first magnetic array.

9. The permanent magnetic actuator of claim 6, further comprising:

a second magnetic array comprising nested outer and middle magnets and an inner magnet, said second magnetic array being located on the opposite side of said conductive coil from said first magnetic array, wherein the outer magnet of said second magnetic array has a magnetization directed substantially parallel to the direction of the magnetization of the inner magnet of said first magnetic array, the middle magnet of said second magnetic array has a radial magnetization in substantially the same direction as the middle magnet of the first magnetic array, and the inner magnet of said second magnetic array has a magnetization substantially anti-parallel to the magnetization of the outer magnet of said second magnetic array;

wherein said conductive coil is disposed between said first and said second magnetic arrays, and wherein the magnetic field of said first and said second magnetic arrays is substantially perpendicular to said current located in said conductive coil.

10. The permanent magnetic actuator of claim 9, further comprising annular ferromagnetic flux posts disposed between first and second magnetic arrays.

11. The permanent magnetic actuator of claim 9, further comprising ferromagnetic flux posts disposed between first and second magnetic arrays.

12. The permanent magnetic actuator of claim 9, wherein the conductive coil is wound in a pancake winding.

13. The permanent magnetic actuator of claim 9, wherein the conductive coil is wound in a solenoidal winding.

14. The permanent magnetic actuator of claim 9, wherein the conductive coil is wound in a toroidal winding.

15. The permanent magnetic actuator of claim 9, wherein the magnetic arrays are canted.

16. The permanent magnetic actuator of claim 9, wherein the conductive coil is wound with two toroidal windings, such that the windings have the same poloidal sense but opposite toroidal sense.

17. The permanent magnetic actuator of claim 9, wherein the conductive coil is wound with two toroidal windings, such that the windings have the same toroidal sense but opposite poloidal sense.

18. The permanent magnetic actuator of claim 6, wherein said conductive coil comprises at least one wire having a plurality of turns.

19. The permanent magnetic actuator of claim 18, wherein the conductive coil is wound with two toroidal windings, such that the windings have the same poloidal sense but opposite toroidal sense.

20. The permanent magnetic actuator of claim 18, wherein the conductive coil is wound with two toroidal windings, such that the windings have the same toroidal sense but opposite poloidal sense.

21. The permanent magnetic actuator of claim 6, wherein the inner magnet, middle magnet, and outer magnet are cannulated.

22. The permanent magnetic actuator of claim 6, wherein the inner magnet, is a solid member.

23. The permanent magnetic actuator of claim 6, wherein the inner magnet, middle magnet, and outer magnet are made from NdFeB.

24. The permanent magnetic actuator of claim 6, wherein the inner magnet, middle magnet, and outer magnet are made from SmCo.

25. The permanent magnetic actuator of claim 6, wherein the conductive coil is wound in a pancake winding.

26. The permanent magnetic actuator of claim 6, wherein the conductive coil is wound in a solenoidal winding.

27. The permanent magnetic actuator of claim 6, wherein the conductive coil is wound in a toroidal winding.

28. The permanent magnetic actuator of claim 6, wherein the conductive coil is wound with two toroidal windings, such that the windings have the same poloidal sense but opposite toroidal sense.

29. The permanent magnetic actuator of claim 28, wherein the magnetic arrays are canted.

30. The permanent magnetic actuator of claim 6, wherein the conductive coil is wound with two toroidal windings, such that the windings have the same toroidal sense but opposite poloidal sense.

31. The permanent magnetic actuator of claim 30, wherein the magnetic arrays are canted.

32. A method for creating a magnetic force comprising:

creating a magnetic field engulfing a conductive coil, said magnetic field comprising the superposition of a first magnetic field curling from an inner magnet of a magnetic array outward to an outer magnet of said magnetic array, and a second magnetic field pointing radially outward from a middle magnet of said magnetic array; and applying a current through said conductive coil.

33. A nested magnetic array comprising:

an outer annular magnet having a magnetization pointing in an axial direction;

a middle annular magnet having a radial magnetization substantially perpendicular to the magnetization of said outer annular magnet; and an inner cylindrical magnet having a magnetization directed substantially anti-parallel to the magnetization of said outer annular magnet.

34. The magnetic array of claim 33, wherein the inner cylindrical magnet, middle annular magnet, and outer annular magnet are cannulated.

35. The magnetic array of claim 33, wherein the inner cylindrical magnet, is a solid member.

36. The magnetic array of claim 33, wherein the inner cylindrical magnet, middle annular magnet, and outer annular magnet are made from NdFeB.

37. The magnetic array of claim 33, wherein the inner cylindrical magnet, middle annular magnet, and outer annular magnet are made from SmCo.

38. A permanent magnetic actuator comprising:

a first magnetic array comprising nested outer and middle annular magnets and an inner cylindrical magnet, wherein the outer annular magnet of said first magnetic array has a magnetization pointing in an axial direction, the middle annular magnet of said first magnetic array has a radial magnetization, and the inner cylindrical magnet of said first magnetic array has a magnetization directed substantially anti-parallel to the magnetization of said outer annular magnet; and a conductive coil having a current distributed over the volume of said conductive coil, wherein the magnetic field of said first magnetic array is substantially perpendicular to said current in said coil.

39. The permanent magnetic actuator of claim 38, wherein said conductive coil is located below said first magnetic array.

40. The permanent magnetic actuator of claim 38, wherein said conductive coil is located above said first magnetic array.

41. The permanent magnetic actuator of claim 38, further comprising:

a second magnetic array comprising nested outer and middle annular magnets and an inner cylindrical magnet, said second magnetic array being located on the opposite side of said conductive coil from said first magnetic array, wherein the outer annular magnet of said second magnetic array has a magnetization directed substantially parallel to the direction of the magnetization of the inner cylindrical magnet of said first magnetic array, the middle annular magnet of said second magnetic array has a radial magnetization in substantially the same direction as the middle annular magnet of the first magnetic array, and the inner cylindrical magnet of said second magnetic array has a magnetization substantially anti-parallel to the magnetization of the outer annular magnet of said second magnetic array;

wherein said conductive coil is disposed between said first and said second magnetic arrays, and wherein the magnetic field of said first and said second magnetic arrays is substantially perpendicular to said current located in said conductive coil.

42. The permanent magnetic actuator of claim 41, further comprising annular ferromagnetic flux posts disposed between first and second magnetic arrays.

43. The permanent magnetic actuator of claim 41, further comprising ferromagnetic flux posts disposed between first and second magnetic arrays.

44. The permanent magnetic actuator of claim 41, wherein the conductive coil is wound in a pancake winding.

45. The permanent magnetic actuator of claim 41, wherein the conductive coil is wound in a solenoidal winding.

46. The permanent magnetic actuator of claim 41, wherein the conductive coil is wound in a toroidal winding.

47. The permanent magnetic actuator of claim 41, wherein the conductive coil is wound with two toroidal windings, such that the windings have the same poloidal sense but opposite toroidal sense.

48. The permanent magnetic actuator of claim 41, wherein the conductive coil is wound with two toroidal windings, such that the windings have the same toroidal sense but opposite poloidal sense.

49. The permanent magnetic actuator of claim 38, wherein said conductive coil comprises at least one wire having a plurality of turns.

50. The permanent magnetic actuator of claim 38, wherein the inner cylindrical magnet, middle annular magnet, and outer annular magnet are cannulated.

51. The permanent magnetic actuator of claim 38, wherein the inner cylindrical magnet, is a solid member.

52. The permanent magnetic actuator of claim 38, wherein the inner cylindrical magnet, middle annular magnet, and outer annular magnet are made from NdFeB.

53. The permanent magnetic actuator of claim 38, wherein the inner cylindrical magnet, middle annular magnet, and outer annular magnet are made from SmCo.

54. The permanent magnetic actuator of claim 38, wherein the conductive coil is wound in a pancake winding.

55. The permanent magnetic actuator of claim 38, wherein the conductive coil is wound in a solenoidal winding.

56. The permanent magnetic actuator of claim 38, wherein the conductive coil is wound in a toroidal winding.

57. A method for creating a magnetic force comprising:

creating a magnetic field engulfing a conductive coil, said magnetic field comprising the superposition of a first magnetic field curling from an inner cylinder of a magnetic array outward to an outer ring of said magnetic array, and a second magnetic field pointing radially outward from a middle annular ring of said magnetic array; and applying a current through said conductive coil.

58. A nested magnetic array comprising:

an outer annular magnet having a magnetization pointing in an axial direction;

a middle annular magnet having a radial magnetization substantially perpendicular to the magnetization of said outer annular magnet; and an inner annular magnet having a magnetization directed substantially anti-parallel to the magnetization of said outer annular magnet.

59. The magnetic array of claim 58, wherein the inner annular magnet, middle annular magnet, and outer annular magnet are cannulated.

60. The magnetic array of claim 58, wherein the inner annular magnet, is a solid member.

61. The magnetic array of claim 58, wherein the inner annular magnet, middle annular magnet, and outer annular magnet are made from NdFeB.

62. The magnetic array of claim 58, wherein the inner annular magnet, middle annular magnet, and outer annular magnet are made from SmCo.

63. A permanent magnetic actuator comprising:

a first magnetic array comprising nested outer and middle annular magnets and an inner annular magnet, wherein the outer annular magnet of said first magnetic array has a magnetization pointing in an axial direction, the middle annular magnet of said first magnetic array has a radial magnetization, and the inner annular magnet of said first magnetic array has a magnetization directed substantially anti-parallel to the magnetization of said outer annular magnet; and a conductive coil having a current distributed over the volume of said conductive coil, wherein the magnetic field of said first magnetic array is substantially perpendicular to said current in said coil.

64. The permanent magnetic actuator of claim 63, wherein said conductive coil is located below said first magnetic array.

65. The permanent magnetic actuator of claim 63, wherein said conductive coil is located above said first magnetic array.

66. The permanent magnetic actuator of claim 63, further comprising:

a second magnetic array comprising nested outer and middle annular magnets and an inner annular magnet, said second magnetic array being located on the opposite side of said conductive coil from said first magnetic array, wherein the outer annular magnet of said second magnetic array has a magnetization directed substantially parallel to the direction of the magnetization of the inner annular magnet of said first magnetic array, the middle annular magnet of said second magnetic array has a radial magnetization in substantially the same direction as the middle annular magnet of the first magnetic array, and the inner annular magnet of said second magnetic array has a magnetization substantially anti-parallel to the magnetization of the outer annular magnet of said second magnetic array;

wherein said conductive coil is disposed between said first and said second magnetic arrays, and wherein the magnetic field of said first and said second magnetic arrays is substantially perpendicular to said current located in said conductive coil.

67. The permanent magnetic actuator of claim 66, further comprising annular ferromagnetic flux posts disposed between first and second magnetic arrays.

68. The permanent magnetic actuator of claim 66, further comprising ferromagnetic flux posts disposed between first and second magnetic arrays.

69. The permanent magnetic actuator of claim 66, wherein the conductive coil is wound in a pancake winding.

70. The permanent magnetic actuator of claim 66, wherein the conductive coil is wound in a solenoidal winding.

71. The permanent magnetic actuator of claim 66, wherein the conductive coil is wound in a toroidal winding.

72. The permanent magnetic actuator of claim 66, wherein the conductive coil is wound with two toroidal windings, such that the windings have the same poloidal sense but opposite toroidal sense.

73. The permanent magnetic actuator of claim 66, wherein the conductive coil is wound with two toroidal windings, such that the windings have the same toroidal sense but opposite poloidal sense.

74. The permanent magnetic actuator of claim 63, wherein said conductive coil comprises at least one wire having a plurality of turns.

75. The permanent magnetic actuator of claim 63, wherein the inner annular magnet, middle annular magnet, and outer annular magnet are cannulated.

76. The permanent magnetic actuator of claim 63, wherein the inner annular magnet is a solid member.

77. The permanent magnetic actuator of claim 63, wherein the inner annular magnet, middle annular magnet, and outer annular magnet are made from NdFeB.

78. The permanent magnetic actuator of claim 63, wherein the inner annular magnet, middle annular magnet, and outer annular magnet are made from SmCo.

79. The permanent magnetic actuator of claim 63, wherein the conductive coil is wound in a pancake winding.

80. The permanent magnetic actuator of claim 63, wherein the conductive coil is wound in a solenoidal winding.

81. The permanent magnetic actuator of claim 63, wherein the conductive coil is wound in a toroidal winding.

82. The permanent magnetic actuator of claim 63, wherein the conductive coil is wound with two toroidal windings, such that the windings have the same poloidal sense but opposite toroidal sense.

83. The permanent magnetic actuator of claim 63, wherein the conductive coil is wound with two toroidal windings, such that the windings have the same toroidal sense but opposite poloidal sense.

84. A method for creating a magnetic force comprising:

creating a magnetic field engulfing a conductive coil, said magnetic field comprising the superposition of a first magnetic field curling from an inner ring of a magnetic array outward to an outer ring of said magnetic array, and a second magnetic field pointing radially outward from a middle annular ring of said magnetic array; and applying a current through said conductive coil.

* * * * *

UNITED STATES PATENT AND TRADEMARK OFFICE

CERTIFICATE OF CORRECTION

PATENT NO. : 6,828,890 B2 
DATED : December 7, 2004
INVENTOR(S) : Andrew M. Wright and David B. Cope It is certified that error appears in the above-identified patent and that said Letters Patent is hereby corrected as shown below:

Title page,
Item [75], Inventors, change "David B. Cope and Andrew M. Wright" to -- Andrew M. Wright and David B. Cope --

Signed and Sealed this

Nineteenth Day of April, 2005

JON W. DUDAS
*Director of the United States Patent and Trademark Office*